US007724143B2

(12) United States Patent
Seppä et al.

(10) Patent No.: US 7,724,143 B2
(45) Date of Patent: May 25, 2010

(54) ANTENNA CONSTRUCTION, FOR EXAMPLE FOR AN RFID TRANSPONDER SYSTEM

(75) Inventors: Heikki Seppä, Helsinki (FI); Kaarle Jaakkola, Helsinki (FI)

(73) Assignee: Valtion Teknillinen Tutkimuskeskus, Espoo (FI)

( * ) Notice: Subject to any disclaimer, the term of this patent is extended or adjusted under 35 U.S.C. 154(b) by 238 days.

(21) Appl. No.: 11/920,235

(22) PCT Filed: May 8, 2006

(86) PCT No.: PCT/FI2006/000149

§ 371 (c)(1),
(2), (4) Date: Feb. 21, 2008

(87) PCT Pub. No.: WO2006/120287

PCT Pub. Date: Nov. 16, 2006

(65) Prior Publication Data

US 2009/0096612 A1 Apr. 16, 2009

(30) Foreign Application Priority Data

May 12, 2005 (FI) ..... 20050507

(51) Int. Cl.
*G08B 13/14* (2006.01)

(52) U.S. Cl. ..... 340/572.7; 340/572.1; 340/10.1; 343/760; 343/881

(58) Field of Classification Search ..... 340/10.1, 340/572.1, 572.7; 343/760, 881
See application file for complete search history.

(56) References Cited

U.S. PATENT DOCUMENTS

| | | | | |
|---|---|---|---|---|
| 5,023,621 | A | | 6/1991 | Ushiyama et al. |
| 5,410,749 | A | * | 4/1995 | Siwiak et al. ..... 455/280 |
| 5,969,680 | A | * | 10/1999 | Tsuru et al. ..... 343/700 MS |
| 2004/0056823 | A1 | | 3/2004 | Zuk et al. |
| 2004/0201539 | A1 | | 10/2004 | Yewen |

FOREIGN PATENT DOCUMENTS

| | | | |
|---|---|---|---|
| WO | WO-03/007232 | A1 | 1/2003 |

* cited by examiner

*Primary Examiner*—Benjamin C Lee
*Assistant Examiner*—Samuel J Walk
(74) *Attorney, Agent, or Firm*—Birch, Stewart, Kolasch & Birch, LLP

(57) ABSTRACT

The invention relates to an antenna construction for a double-ended antenna circuit 4. The antenna construction comprises a conductive ground place (6) on a first surface, a transmission line (3) on at least one second surface, connected to the ground plane (6) through a fold (1) in the edge of the antenna construction, so that the fold acts as a primary source of a magnetic field, an insulation layer (7) arranged between the first and the second surfaces, and an electronic component (4), in which there is a double-ended antenna connector, connected to the antenna construction. According to the invention, the electronic component (4) is attached to the second surface of the antenna construction and connected from the first antenna terminal to the transmission line (3) and from the second terminal to either a second transmission line (3) or the fold (1).

17 Claims, 5 Drawing Sheets

ANTENNA CONSTRUCTION, FOR EXAMPLE FOR AN RFID TRANSPONDER SYSTEM

The present invention relates to an antenna construction according to the preamble of Claim 1.

The invention also relates to the operation of the antenna construction.

The antenna is used, for example, with remote-identifier circuits.

The use of RFID will increase in the next few years. It will mostly replace, for example, optically-read bar-codes in product marking. An RFID transponder is a mark that can be read remotely by means of a radio signal, and which comprises an antenna, a voltage-generating circuit, rf-signal modulation/demodulation circuits, and a memory. It is possible to both write in the memory and to read from it with the aid of a radio signal. There are several different types of RFID transponder: passive and active, as well as those to which a connection can be made inductively, capacitively, or with the aid of a radio-frequency radiation field. Passive transponders generate the electrical energy they need from the rf field aimed at them. In active transponders, there is a separate battery or other power supply. Inductively connected remote sensors typically operate at frequencies of 100-125 kHz or 13.56 MHz.

The most preferred embodiments of the present invention relate to passive RFID transponders readable using a radio-frequency radiation field, but the antenna type is advantageous in all applications in which the antenna is required to have a long reading distance, a thin structure, and to be able to be attached to some base, for example, the surface of goods or packages. Such a surface is usually flat. The frequencies most advantageously suitable for the invention are 869 MHz and 2.45 Ghz.

An RFID transponder is a small device comprising an antenna, a microcircuit, and a memory, which transmits the contents of its memory by backscattering, when it receives a transmit command from a reading device and the reading device illuminates it with a radio signal. In a passive RFID transponder there is no battery, instead it draws the operating power it requires from the radio signal transmitted to it. The transmission of power and information between the transponder and the reading device can take place with the aid of a magnetic field, an electrical field, or a radiating radio signal. In many transponder applications, it is important for the distance between the reader and the transponder to be long—even up to several meters.

Attempts have already been made to use RFID transponders commercially even on an extensive scale. However, RFID transponders, which in laboratory conditions have achieved long reading distances, have, in practical situations, been measured as having considerably shorter reading distances. The deterioration in the results has been caused by the fact that the base, to which the transponder is attached, has caused a considerable change in the properties of the antenna of the transponder.

A PIFA is an antenna that is used very widely in, for example, mobile telephone applications. Generally it is fed from near a fold, so that the impedance can be brought to close to 50 Ohm. The feed also takes place through the 'ground plane'. A PIFA antenna can also be applied in connection with RFID circuits, in which the real component of the impedance is large, as the feed point is brought close to the open end of the antenna. In this embodiment, a via is required to the ground plane of the PIFA for the RFID circuit. If, in addition to this, the antenna is slightly shorter than one quarter of the wavelength, the antenna will remain inductive and the impedance can be adapted to an RFID circuit with capacitive input impedance. A problem with a PIFA antenna is that it requires a via and this increase manufacturing costs significantly. If the antenna is manufactured by exploiting, for example, high-frequency circuit-board technology, the cost of the antenna can be as much as several euros.

The present invention is intended to eliminate the defects of the prior art to create an entirely new type of system, method, and procedure for making power measurements.

The invention is based on the electronic component, such as an RFID circuit, being attached to one surface of the antenna structure and connected from the one antenna terminal to the transmission line and from the other terminal either to a second transmission line, or to the fold.

More specifically, the antenna construction according to the invention is characterized by what is stated in the characterizing portion of Claim 1.

The procedure according to the invention is, in turn, characterized by what is stated in the characterizing portion of Claim 7.

Considerable advantages are gained with the aid of the invention.

With the aid of embodiments of the invention, a thin antenna structure is achieved, which has a very long reading distance. The antenna type is also immune to the surface to which it is attached. The antenna type according to the embodiments of the invention is also economical to manufacture, because vias are not required. In addition, the sensor structure can also be easily and at low cost combined, for example with RFID electronics.

In the following, the invention is examined with the aid of examples of embodiments according to the accompanying figures.

Figure 1:
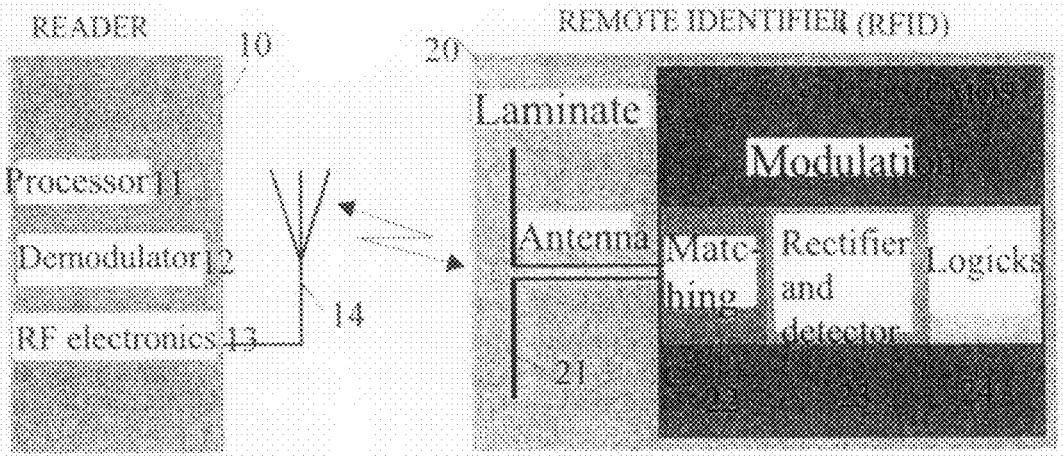
FIG. 1 shows a remote reading system according to the prior art, to which the antenna according to the invention can be applied.

The typical remote reading system according to FIG. 1 comprises a reading device 10, and an RFID transponder 20, which are in wireless communication with each other. The reader 10 typically comprises a processor 11, a demodulator 12, and RF electronics 13, as well as an antenna 14 for producing and receiving a radio-frequency signal. The RFID transponder 20 in turn includes an antenna 21, a matching circuit 22, a rectifier with a detector 23, and a logic circuit 24. The modulation is implemented by means of the combined operation of the logic 24 and the matching circuit 22. In this embodiment, the RFID transponder is laminated onto thin sheet, usually of credit-card size.

The present invention presents an antenna with a high efficiency, in which there is no need for a via. We will refer to the antenna as a planar asymmetrically fed folder antenna (PAFFA).

Figure 2:
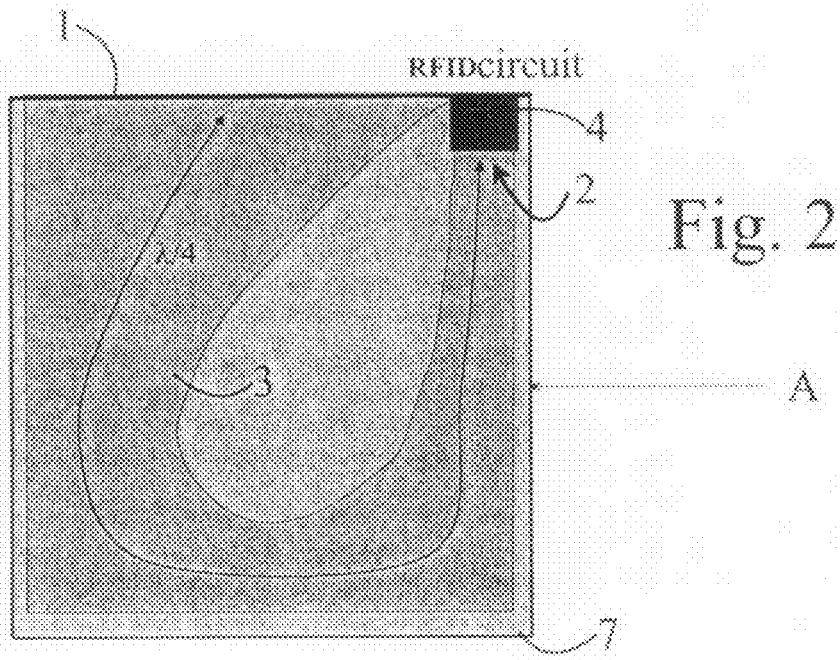
FIG. 2 shows a top view of one sensor according to the invention.

FIG. 2 shows the antenna, in which one end of a planar transmission line 3 formed on top of an insulation layer 7, is brought close to the 'ground plane' of the antenna. The antenna is made very small, but, because the source (the fold) 1 of the magnetic field and the source 2 of the electric field (the open end of the resonator) come close to each other, the situation affects the radiation impedance and the orientation of the power. The fold 1 acts as the primary source of the magnetic field. Simulations show that the antenna works, but that its efficiency remains reasonably poor (20%-30%). However, the antenna is very small in size (app. 30 cm×30 cm, when the frequency is 869 MHz and the relative dielectric constant is 2.5, app. 12 cm×12 cm, when the frequency is 2.45 Ghz) and can be used in applications, in which a smallish distance is sufficient. In this case, the RFID circuit 4 is fitted close to the fold 1. The two antenna terminals of the RFID circuit are connected between the source 1 of the magnetic field and the source 2 of the electric field. The length of the transmission line 3 is, in this embodiment, one quarter of the wavelength of the operating frequency ($\lambda/4$).

Figure 3:
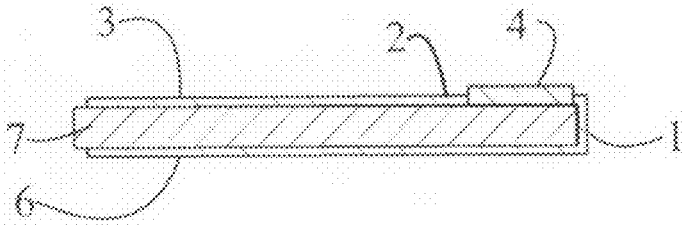
FIG. 3 shows a side view from direction A of the sensor according to FIG. 2.

FIG. 3 shows the antenna construction of FIG. 2, seen from the direction of the arrow A. This figure shows more clearly the connection of the RFID circuit between the source 1 of the magnetic field and the source 2 of the electric field.

Figure 4:
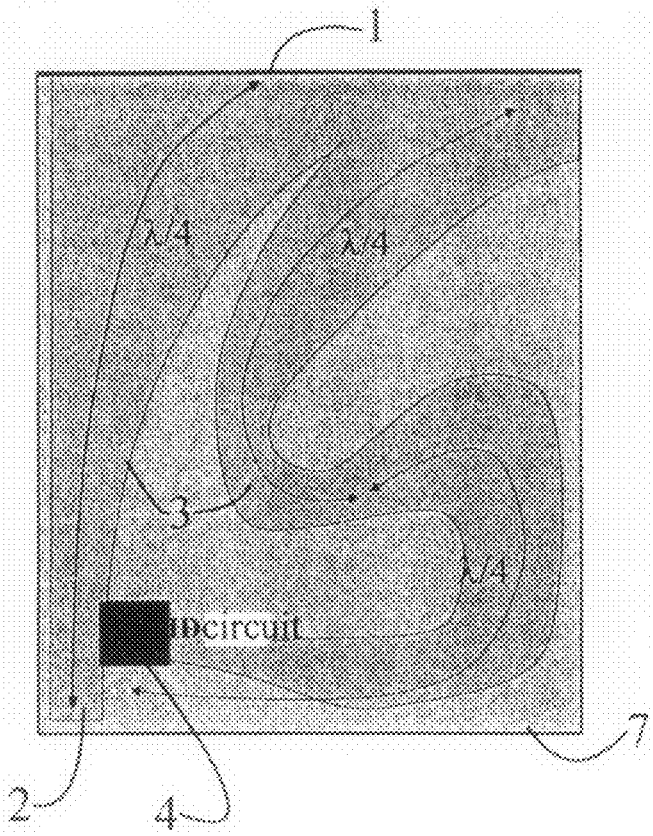
FIG. 4 shows a top view of a second sensor according to the invention.

FIG. 4 shows an antenna, in which the RFID circuit 4 is set about at a distance of about one-quarter of a wavelength from the fold 1 and in which the other end of the RFID circuit 4 is grounded using an open transmission line 3 with a length of one-quarter of a wavelength. The RFID circuit 4 is fitted to the antenna by varying the length and width of the transmission line 3 and the thickness of the insulation 7. The antenna is shaped in such a way that the transmission line 3 is broad at the points at which the current density is high, but narrow at the maxima 2 of the electric field. By using this arrangement, we can reduce the size of the antenna, while retaining a good efficiency in the antenna. On the other hand, the electric field arising close to the RFID circuit is a considerable distance from the magnetic dipole, compared to the circuit of FIG. 2, and thus the antenna radiates quite as well as a traditional PIFA. The only difference is that the $\lambda/4$-long transmission line used to ground the RFID circuit 4 also radiates to some extent. On the basis of simulations and measurements, the antenna of the type of FIG. 4 works well, but it is difficult to make the impedance sufficiently high for the RFID circuit 4. We have studied an antenna according to FIG. 4, the size of which is less than 60 cm×60 cm, at a frequency of 869 MHz.

Figure 5:
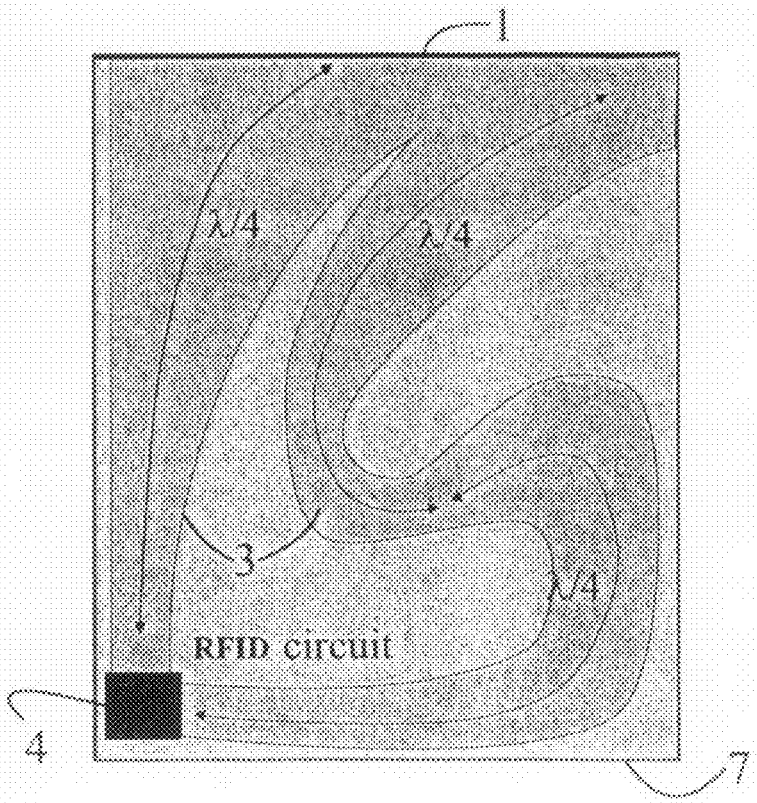
FIG. 5 shows a top view of a third sensor according to the invention.

FIG. 5 shows an antenna, which greatly recalls the antenna of FIG. 4. In this case however, the RFID circuit 4 is grounded using a $\lambda/2$-long transmission line 3 (the transmission line on the right-hand side of the figure), which ends at the fold 1. The essential difference from the antenna of FIG. 4 is that, due to the length of the construction, two current maximum points arise, both of which radiate. Simulations of this antenna show that using the antenna in question, at a frequency of 869 MHz and using a low-loss insulation 7, an efficiency of 70%-80% and very good impedance matching with the RFID circuit, which input impedance is 6-j200Ω, are obtained. The simulations were made using an antenna, the size of which was less than 60 cm×60 cm at a frequency of 869 MHz.

The location of the circuit on the antenna can vary greatly, always according to the impedance of the RFID circuit.

Figure 6:
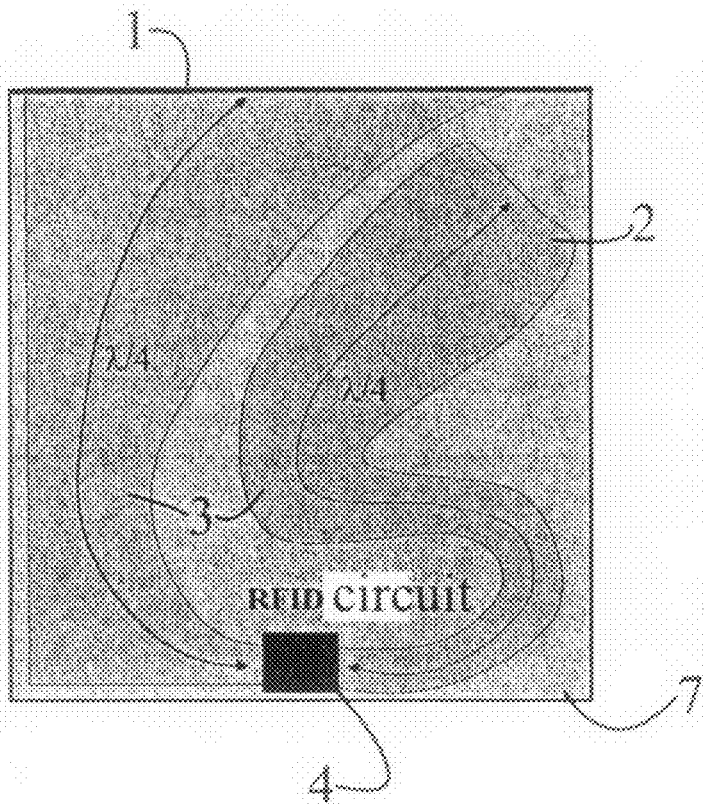
FIG. 6 shows a top view of a fourth sensor according to the invention.

FIG. 6 shows one way, in which the RFID circuit 4 is fed slightly before the open end 2 of the ¼ line. Using this method, it is possible to reduce the impedance (the ratio of the real and imaginary components remain nearly constant, but the length of the vector varies). The same method can be used in all the antennas presented in this invention, for matching the impedance.

Because a via is not required in the antenna according to the invention, it is possible to make the antenna, for example, on flat plastic, on which the antenna pattern is built by etching or growing. An RFID circuit can be connected to this construction. If the plastic is sufficiently thin (1 mm-2 mm), it can be brought to the process directly from a roll. The line can be broad, so that the machine can produce several antennae parallel to each other. After the attachment of the circuit 4, the wide construction is cut into parts (the width of one web is twice the final width of the antenna). Finally the construction is heated and folded and cut to form a separate RFID transponder. If the original thickness of the plastic is 1 mm, the thickness of the insulation after the forming of the antenna will be 2 mm, which, according to simulations and tests will result in a reasonably good antenna. Thicker plastic can also possibly be used, in which case the efficiency of the antenna can be improved. Because the raw material of the process can be brought straight from a roll and the growing or etching of the antenna image can be made continuous, the entire process can be made continuous and subsequently very economical. Antennae according to the invention can also be produced in such a way that the antenna image is made on thin plastic, for example, by etching. Next, the antenna is connected to the RFID circuit 4 and the band is cut into a band. This construction can be folded over the edge of the plastic sheet, in such a way that an antenna like that disclosed in this invention is finally formed. This process to can be made considerably economical, as vias are not needed.

The invention has presented a method, in which an RFID circuit is connected to a planarly folded antenna. We refer to the antenna as a PAFFA. The invention has presented a folder antenna, the surface-metallized layer contains a transmission line with a length of about $(2n-1)\lambda/4$, in which n=1,2, 3, . . . . In practice, the best result is obtained by selecting n=1. The RFID circuit is placed at or near to the end of this transmission line. The circuit can also be embedded planarly in insulation material. At the other terminal of the RFID circuit is installed a $n\lambda/2$-long transmission line, which is terminated at the fold, or a $(2n-1)\lambda/4$-long transmission line, which is terminated at the open load. In addition, the antenna is shaped in such a way that the transmission line is broad at the maximum point of the current and narrow at the minimum point of the current. By means of this arrangement, we are able to reduce the size of the antenna while nevertheless keeping the efficiency high. The most significant difference of the antenna from presently used antennas arranged on top of metal is that the RFID circuit need not be galvanically grounded through the insulation layer.

The lengths of the transmission lines 3 refer to the lengths of the lines drawn in the middle of the transmission lines 3 shown in the figures in this application.

Figure 7:
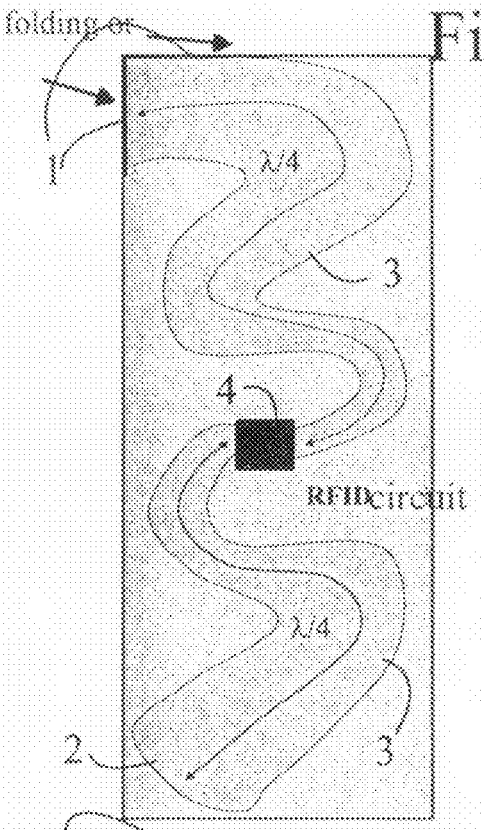
FIG. 7 shows a top view of a fifth sensor according to the invention.
Figure 8:
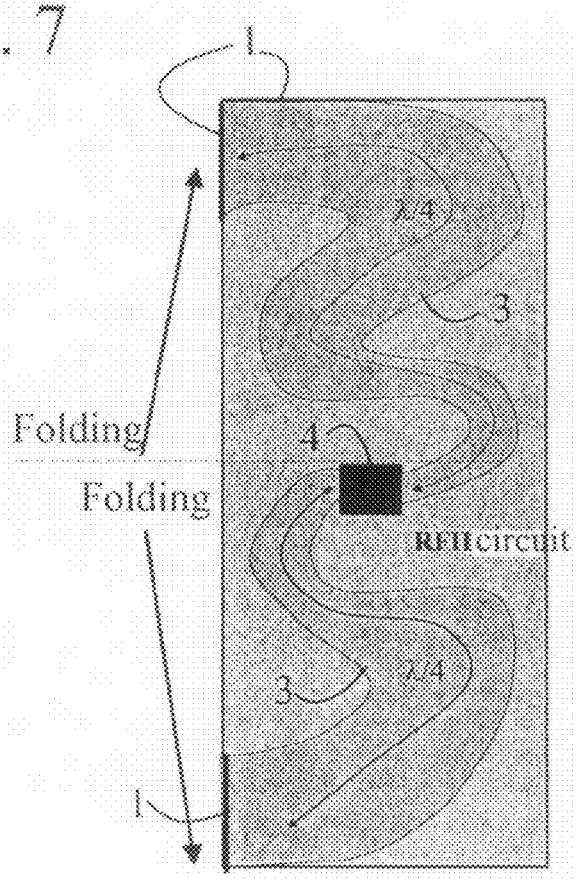
FIG. 8 shows a top view of a sixth sensor according to the invention.
Figure 9:
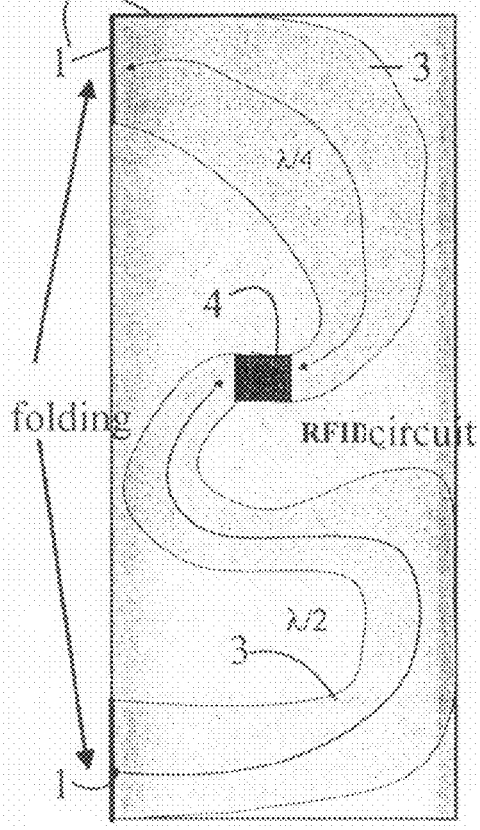
FIG. 9 shows a top view of a seventh sensor according to the invention.
Figure 9:
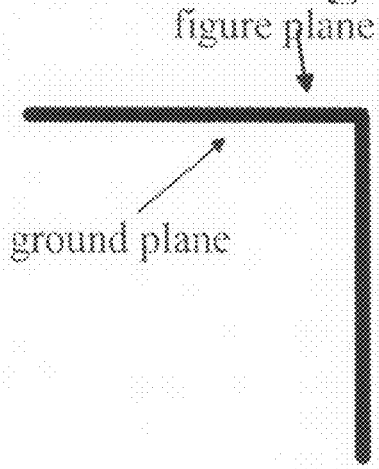

In practice, there is also a need to make narrow and long structures, so that it is worth giving the structure presented above a slightly different shape. The principle of course remains, but the outward appearance clearly changes in these alternative solutions of the invention. These alternative solutions are shown in FIGS. 7-9. FIG. 7 shows an antenna, in which plastic is bent, either from the left-hand side or from above, so that the metal fold 1 comes either at the left-hand upper edge or at the upper edge. The distance from this fold 1 to the microcircuit is $\lambda/4+n\lambda/2$. The other side of the circuit (the upper part in the figure) is terminated at the open line 2 and the length is then also $\lambda/4+n\lambda/2$ (n can differ n=0,1, 2, . . . ).

In FIG. 8 is a construction, in which the fold in the plastic is made from the left-hand edge and the metal transmission lines 3 are patterned in such a way that the conductor travels to the ground plane 1 from both the left-hand and right-hand upper sides. Now it is possible to make two alternatives a) the upper line 3 is $\lambda/4+n\lambda/2$ and the lower is $\lambda/2+n\lambda 2$, as in FIG. 9, or b) both implement the equation $\lambda/4+n\lambda/2$, as in FIG. 9. Of course, n can be any value at all in all the separate transmission lines. All these antennae can still be folded at an angle of 90 degrees, as is shown in the lower right-hand drawing. In other ways too the antennae disclosed in the invention can be bent into different shapes, without the antenna properties suffering particularly. The fold affects the radiation pattern, so that this should be taken into consideration in design.

Figure 10:
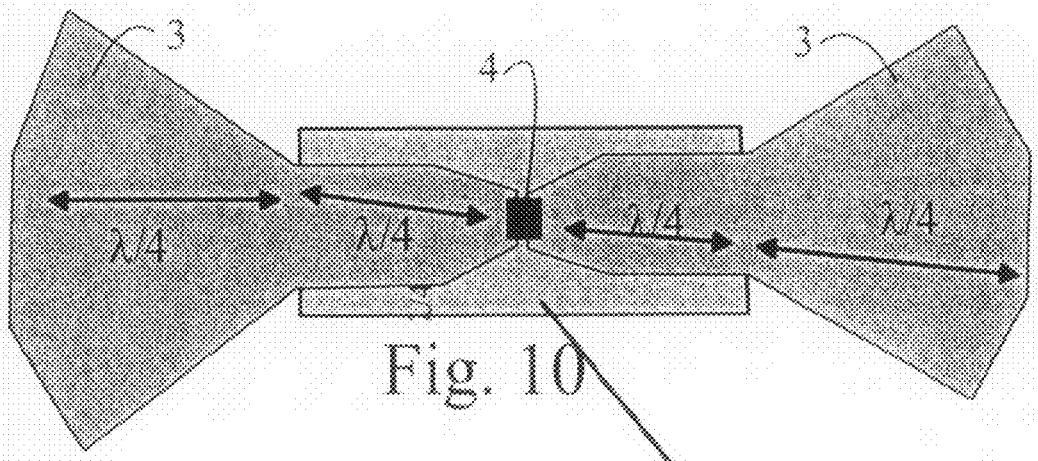
FIG. 10 shows a top view of an eighth sensor according to the invention.
Figure 11:
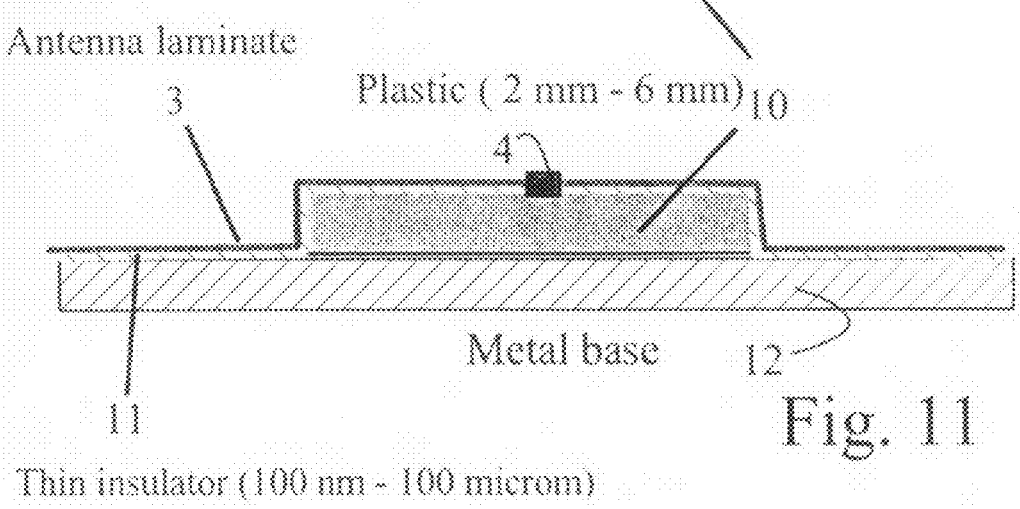
FIG. 11 shows a cross-sectional side view of the sensor according to FIG. 10.

A PAFFA antenna can also be implemented with a construction according to FIGS. 10 and 11. If the base is a metal layer 12, we can use this directly as the ground place of the PAFFA. A plastic piece 10 (for example, polyethylene), the length of which is about half the wavelength, is placed on top of the metal base 12 in the arrangement of FIGS. 10 and 11. On top of the plastic 10 and the metal layer 12 is placed a thin antenna laminate, which is formed of an insulation layer 11 and an electrically conductive transmission path 3 on top of this. The antenna laminate extends from both sides of the plastic piece 10, against the metal base 12, for about one quarter of the wavelength. It should be noted that the wavelength may differ in the area in which the antenna laminate 3 is directly on top of the metal, from that in the area where it is on top of the plastic, because the speed of light may differ in them, due mainly to differences in the permittivity of the material. Because the wave impedance of the transmission line 3 against the metal 12 is low and because its length is one quarter of the wavelength, an effective short circuit will arise at the edge of the plastic 10 against the metal 12. This arrangement can be used to made, in a way, contact with the ground plane below. Taking this into account, the antenna behaves like the PAFFA antenna folded on both sides. If the conductivity of the metal 12 below is particularly poor, it may be necessary to surface it first with a reasonably well conducting metal layer, the thickness of which can be in the order of 1 μm-10 μm.

An electronic circuit, such as an RFID circuit can be connected to the transmission line 3, either at its end or, according to FIG. 4, at a suitable point in the transmission line. The location is determined by the impedance of the electronic circuit.

The antenna circuit can also be folded at both ends or from two sides, even though this manner may be technically more difficult and more expensive to implement than a single fold.

The invention claimed is:

1. Antenna construction for a double-ended antenna circuit, which comprises a conductive ground place on a first surface, a transmission line on at least one second surface, the transmission line connected to the ground plane through a fold in the edge of the antenna construction, so that the fold acts as a primary source of a magnetic field, an insulation layer arranged between the first and the second surfaces, and an electronic component, in which there is a double-terminal antenna connector, connected to the antenna construction, wherein the electronic component is attached to the second surface of the antenna construction and connected from the first antenna terminal to the transmission line and from the second terminal to either a second transmission line or the fold.

2. Antenna construction according to claim 1, wherein the length of the transmission line connected to the first antenna terminal of the component is $\lambda*(2n-1)¼$, where n=1,2,3.

3. Antenna construction according to claim 1 or 2, wherein the length of the transmission line connected to the second antenna terminal of the component is $\lambda*n½$, where n=0,1,2,3.

4. Antenna construction according to claim 3, wherein the second antenna terminal of the component is connected to the fold, in which case n=0.

5. Antenna construction according to claim 3, wherein the second antenna terminal of the component is connected to the transmission line, the length of which is $\lambda*(2n-1)¼$.

6. Antenna construction according to claim 1 or 2, wherein the component is a passive RFID circuit.

7. The use of the antenna construction according to claim 1 or 2 as the antenna of an RFID circuit.

8. Antenna construction according to claim 3, wherein the component is a passive RFID circuit.

9. Antenna construction according to claim 4, wherein the component is a passive RFID circuit.

10. Antenna construction according to claim 5, wherein the component is a passive RFID circuit.

11. The use of the antenna construction according to claim 3 as the antenna of an RFID circuit.

12. The use of the antenna construction according to claim 4 as the antenna of an RFID circuit.

13. The use of the antenna construction according to claim 5 as the antenna of an RFID circuit.

14. The use of the antenna construction according to claim 6 as the antenna of an RFID circuit.

15. The use of the antenna construction according to claim 8 as the antenna of an RFID circuit.

16. The use of the antenna construction according to claim 9 as the antenna of an RFID circuit.

17. The use of the antenna construction according to claim 10 as the antenna of an RFID circuit.

* * * * *